US006612857B2

(12) United States Patent
Tolmie

(10) Patent No.: US 6,612,857 B2
(45) Date of Patent: Sep. 2, 2003

(54) ELECTRICAL CONNECTOR SYSTEM AND METHOD HAVING OPTICAL AND/OR COOLING CAPABILITY

(76) Inventor: Bernard R. Tolmie, 204 Brand Farm Dr., S. Burlington, VT (US) 05403

( * ) Notice: Subject to any disclaimer, the term of this patent is extended or adjusted under 35 U.S.C. 154(b) by 0 days.

(21) Appl. No.: 10/040,657

(22) Filed: Jan. 7, 2002

(65) Prior Publication Data

US 2003/0008560 A1 Jan. 9, 2003

Related U.S. Application Data

(63) Continuation-in-part of application No. 09/899,394, filed on Jul. 5, 2001, now Pat. No. 6,478,625.

(51) Int. Cl.[7] ..... H01R 4/60; H01R 4/64
(52) U.S. Cl. ..... 439/199; 174/15.1
(58) Field of Search ..... 439/199, 190; 174/15.1, 15.2, 17 LF

(56) References Cited

U.S. PATENT DOCUMENTS

| | | | | |
|---|---|---|---|---|
| 3,790,654 A | | 2/1974 | Bagley | 264/177 |
| 4,846,727 A | | 7/1989 | Glover | 439/608 |
| 5,099,311 A | * | 3/1992 | Bonde et al. | 165/80.4 |
| 5,162,001 A | | 11/1992 | Harwath et al. | |
| 5,175,928 A | * | 1/1993 | Grabbe | 29/884 |
| 5,176,538 A | | 1/1993 | Hansell | 439/607 |
| 5,342,211 A | | 8/1994 | Broeksteeg | |
| 5,346,412 A | | 9/1994 | Fedder et al. | 439/681 |
| 5,460,533 A | | 10/1995 | Broeksteeg et al. | 439/101 |
| 5,518,422 A | | 5/1996 | Zell et al. | 439/608 |
| 5,632,635 A | | 5/1997 | Vanbesien et al. | 439/108 |
| 5,664,968 A | | 9/1997 | Mickievicz | 439/608 |
| 5,741,144 A | | 4/1998 | Elco | 439/101 |
| 5,924,899 A | | 7/1999 | Paagman | 439/701 |
| 6,083,047 A | | 7/2000 | Paagman | 439/608 |
| 6,116,926 A | * | 9/2000 | Ortega et al. | 439/108 |
| 6,132,255 A | | 10/2000 | Verhoeven | 439/608 |

FOREIGN PATENT DOCUMENTS

| | | |
|---|---|---|
| WO | WO97/36349 | 10/1997 |

* cited by examiner

*Primary Examiner*—Lynn Feild
*Assistant Examiner*—Hae Moon Hyeon

(57) ABSTRACT

A rectangular connector assembly having a plurality of contacts, with each contact being enclosed in a metal shield along the contact length is disclosed. The assembly has a rectangular metallic housing that contains a plurality of contact channels through which the contacts are inserted. The contacts are insulated from the surrounding housing by a coating on the inside of the housing. The contacts are connected at one end of the housing to an intermediate printed circuit board. The other end of the housing forms the mate to a receptacle mounted on the motherboard of an electronic system. The housing assemblies are stackable because of their shape. The invention also includes a hybrid electrical-optical connector that employs VCSEL technology, so that both electrical and optical connections can be accommodated in the same connector. Further, the connector can include a connector cooling system to cool the connector.

16 Claims, 13 Drawing Sheets

ELECTRICAL CONNECTOR SYSTEM AND METHOD HAVING OPTICAL AND/OR COOLING CAPABILITY

RELATED APPLICATION AND CROSS-REFERENCE

This application is a continuation-in-part of U.S. patent Ser. No. 09/899,394, entitled "Electrical-optical hybrid connector," filed Jul. 5, 2001, now U.S. Pat. No. 6,478,625 which patent application is incorporated by reference herein, and which patent application has a common inventor. This patent application is also related to U.S. Pat. No. 6,283,792 B1, issued on Sep. 9, 2001, and entitled "Extruded metallic electrical connector assembly and method of producing same," which patent has a common inventor and is commonly assigned with the present patent application.

FIELD OF THE INVENTION

The present invention pertains to electrical connectors, and in particular, to an extruded metallic electrical connector assembly that allows for the connection of optical fibers and/or electrical wires.

BACKGROUND OF THE INVENTION

Electrical connectors are used in many different types of electrical and electronic systems. They come in various sizes depending on the physical and electrical parameter of the installation. Some high-speed digital signal applications require multiple contact connectors in a single rectangular module that are held together and stackable without distorting or adversely modifying the signal intelligence. Digital signals must have a high degree of signal integrity on entering and exiting an electrical connector system. Requirements for connector types, in increasingly high-speed applications include a high degree of shielding, preventing signal distortion from outside Electromagnetic Interference (EMI) and low inductance and resistance for signal and return signal paths.

Rectangular connectors with multiple contacts that are two millimeter (2 mm) or less in center spacing have limits in contact density and signal shielding by currently employed manufacturing processes. However, electronic systems that use high-speed connectors continue to shrink in physical size and require increasing signal density reducing physical size requirements for connectors. Current rectangular connectors having a plurality of contacts have limits in providing dense signal packaging and shielding of each individual contact within the connector-housing module.

Although classical round coaxial connectors have contiguous shielding, along the contact length and provide low inductance and good signal integrity, they do not offer the plurality of contacts, particularly for densities of 2 mm or less in a rectangular configuration. In round coaxial connections, multiple contiguous contacts cannot be densely packed or stacked in a module form to densities attainable in a rectangular configuration and still have each signal contact surrounded with in a metal enclosure along the length of the contact. Connectors of a rectangular shape, having a plurality of contacts 2 mm or less for high-speed signal application, use a combination of injection molded plastics either riveted or press fitted to metal plates to simulate shielding and reduce inductance and resistance to improve signal integrity. However, these connector systems, while providing greater contact densities than round coaxial connectors, do not provide a contiguous metal cavity along the length of each individual contact. Instead only one or two sides of each individual contact has a shield vs. all 4 sides of the extruded connector-housing module described here.

Presently, most high-density connectors are either electrical or optical. Some fiber optic interfaces occur at the printed circuit board level and convert the electrical signal to light (optical) signals through devices such as a vertical cavity surface emitting lasers (VCSELs), whereby the electrical high speed signal is converted into high-speed modulated light signal. However, there is a need for a truly cost-effective, high-density and easy to manufacture hybrid electrical-optical connector.

Further, electrical and electrical-optical hybrid connectors can suffer from Joule heating, which can damage the connector and its components. Accordingly, it is desirable to have a system and method for cooling the connector.

SUMMARY OF THE INVENTION

The present invention pertains to electrical connectors, and in particular, to an extruded metallic electrical connector assembly that allows for the connection of optical fibers and/or electrical wires.

An example embodiment of the invention is a rectangular connector having a plurality of contacts, with each contact being enclosed in a metal shield along the contact length. The assembly has a rectangular metallic housing that contains a plurality of contact channels through which the contacts are inserted. The contacts are insulated from the surrounding housing by a coating on the inside of the housing. The contacts are connected at one end of the housing to an intermediate printed circuit board. The other end of the housing forms the mate to a receptacle mounted on the motherboard of an electronic system. The housing assemblies are stackable because of their shape. The invention also includes a hybrid electrical-optical connector that employs VCSEL technology, so that both electrical and optical connections can be accommodated in the same connector. Further, the connector can include a connector cooling system to cool the connector.

DETAILED DESCRIPTION OF THE INVENTION

The present invention pertains to electrical connectors, and in particular, to an extruded metallic electrical connector assembly that allows for the connection of optical fibers and/or electrical wires. The present invention is related to U.S. Pat. No. 6,283,792 B1, entitled "Extruded metallic electrical connector assembly and method of producing same," formerly U.S. patent application Ser. No. 09/614,171, which patent is incorporated by reference herein. The present invention is also related to U.S. patent application Ser. No. 09/899,394, entitled "Electrical-optical hybrid connector," which patent application is incorporated by reference herein.

As shown in the Figures, the extruded metallic electrical connector assembly 10 provides a four-sided metal enclosure along the contact's length of individual contacts for high-density low inductance, resistance and good signal integrity. This means and method of shielding each individual contact along the contacts length by the connector housing 11 contiguously extruded from metal to form individual channels 12, 12*a*, 12*b*, 12*c* and 12*d* to house each contact providing multiple cavities. In an example embodiment, the contacts are on centers of 2 mm or less. The interior of the channels are insulated from an inserted electrical contact by coating the interior of each channel wall with an insulation material having good dielectric properties for the signal transmission and contact insulation.

Figure 1:
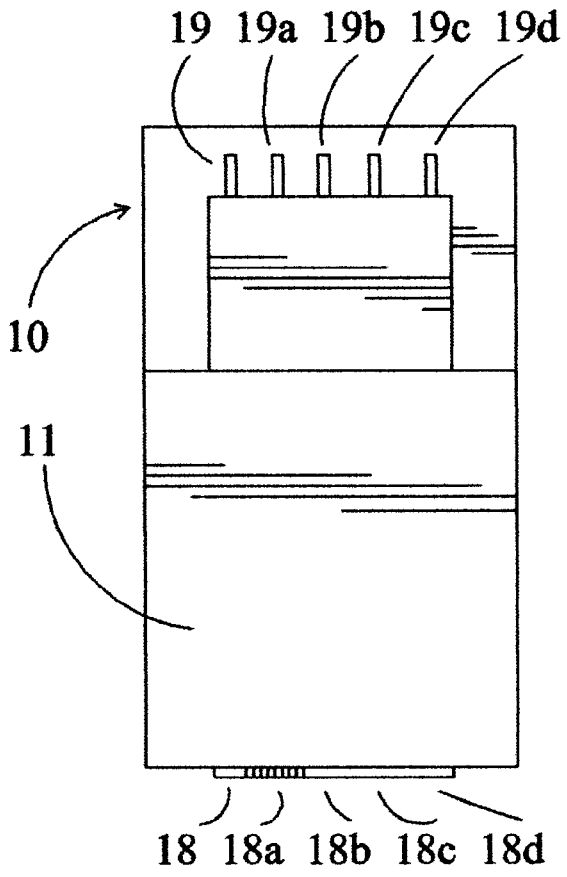
FIG. 1 is a top plan view of the novel extruded metallic connector assembly of the type that can be connected to an electrical cable.
Figure 2:
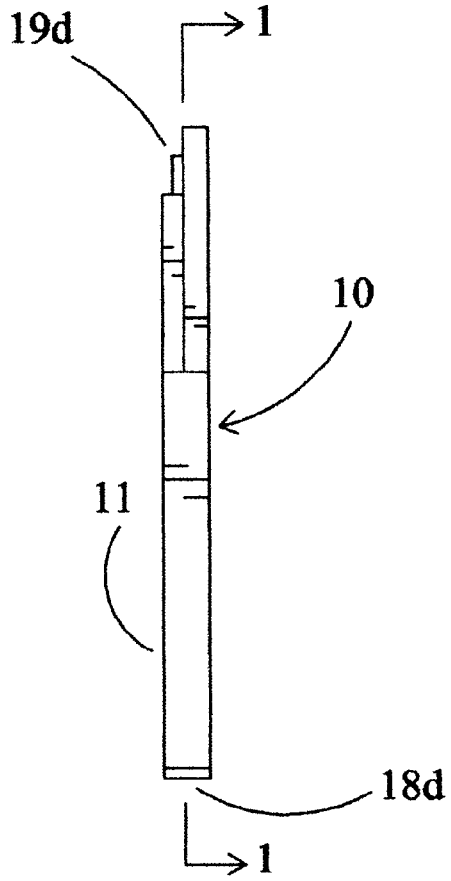
FIG. 2 is a side elevational view thereof.
Figure 3:
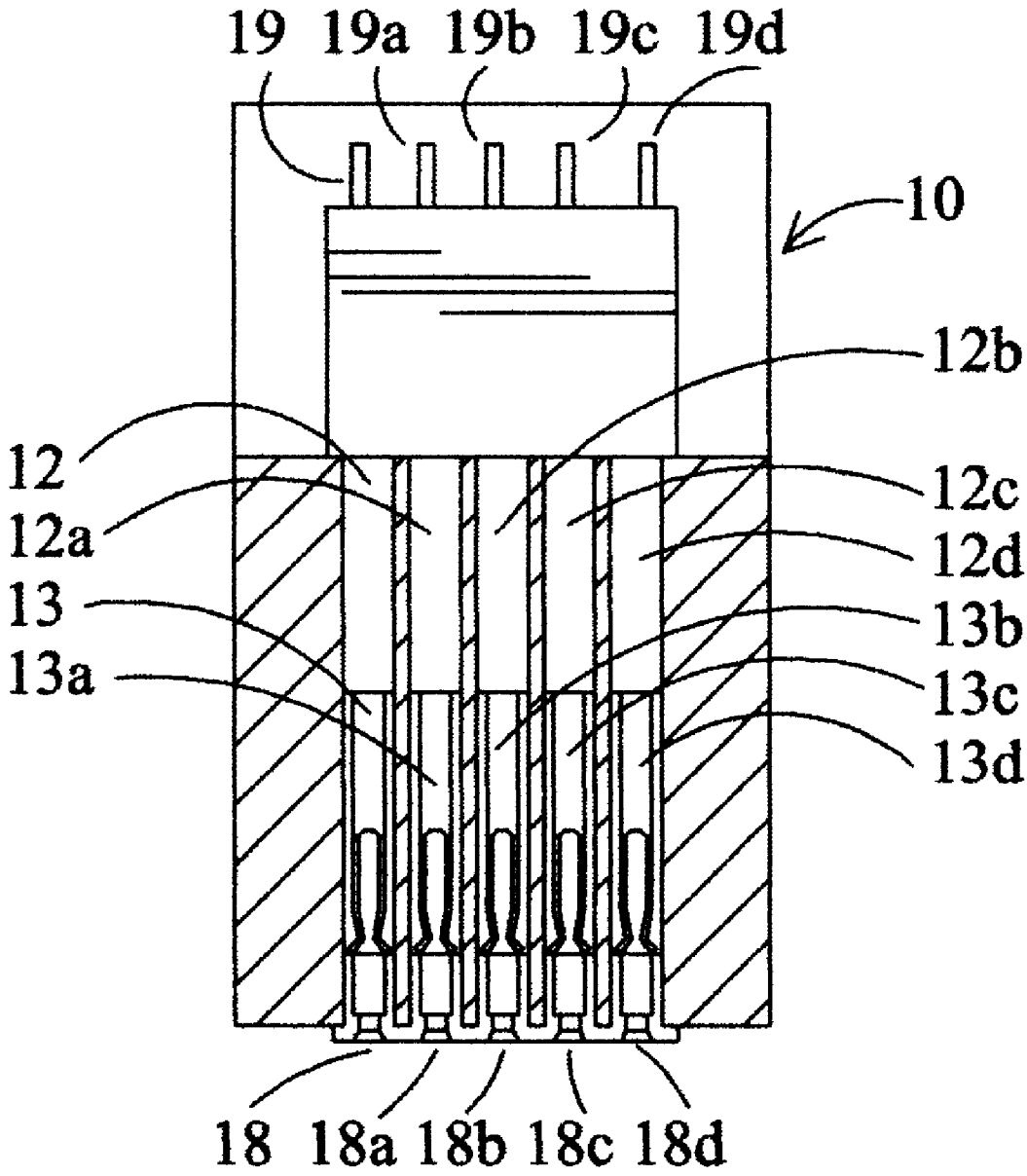
FIG. 3 is a cross sectional view taken along line 1—1 of FIG. 2.
Figure 4:
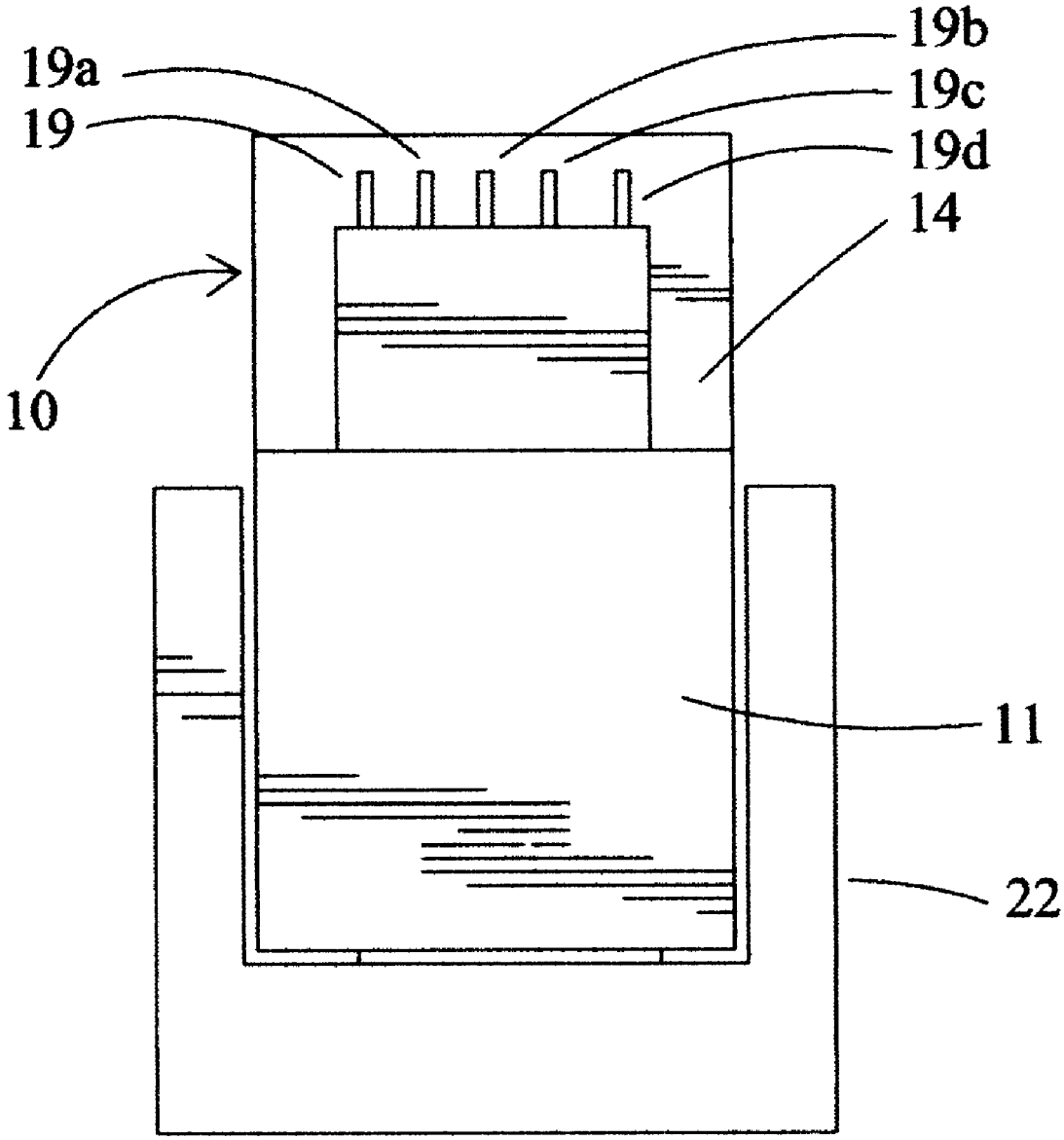
FIG. 4 is a frontal elevational view of connector assembly for mounting a mating receptacle.
Figure 5:
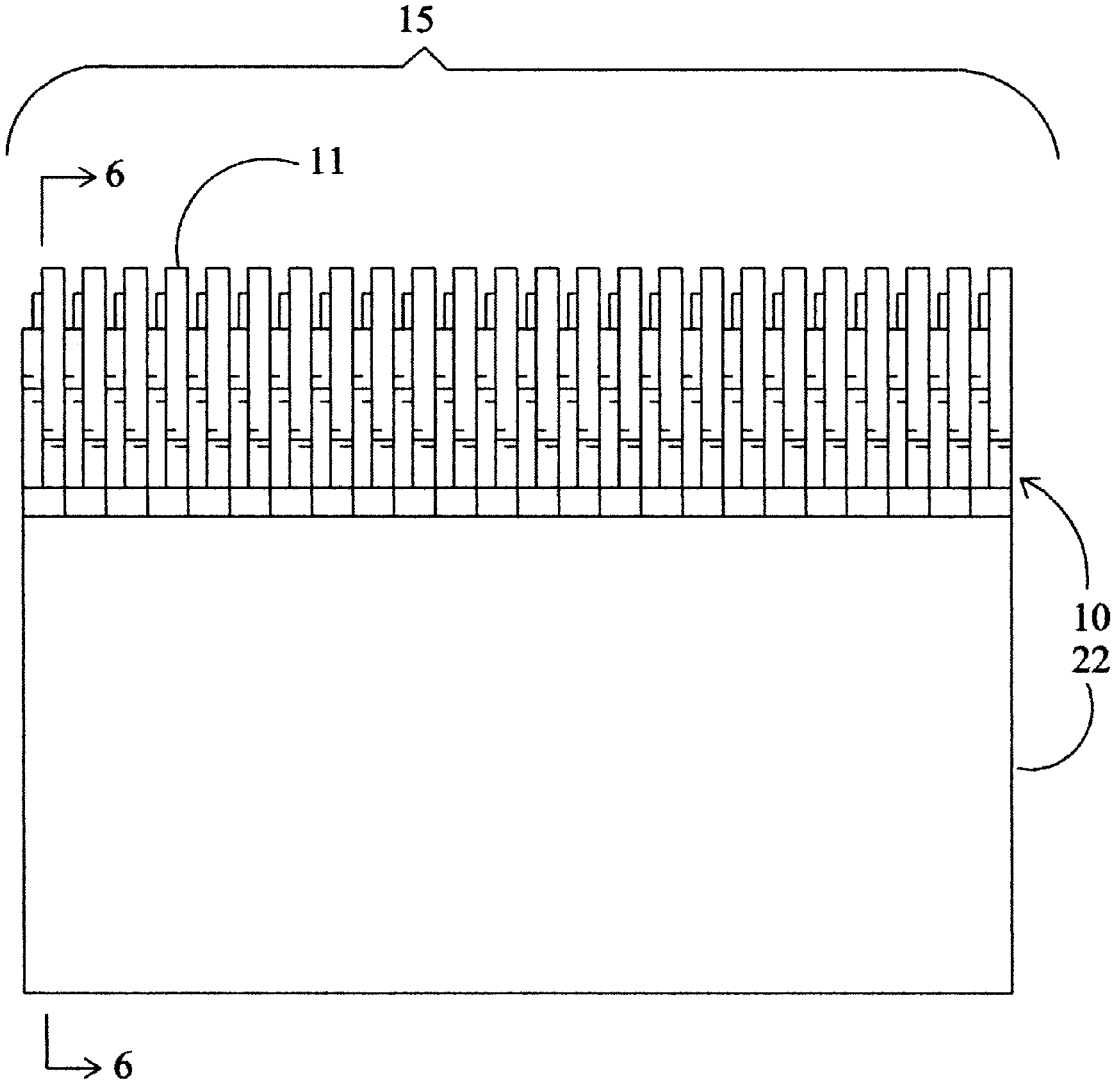
FIG. 5 is a side elevational view of the stacked individual connector assemblies and mated view of connector assemblies for mounting to an electrical cable.
Figure 6:
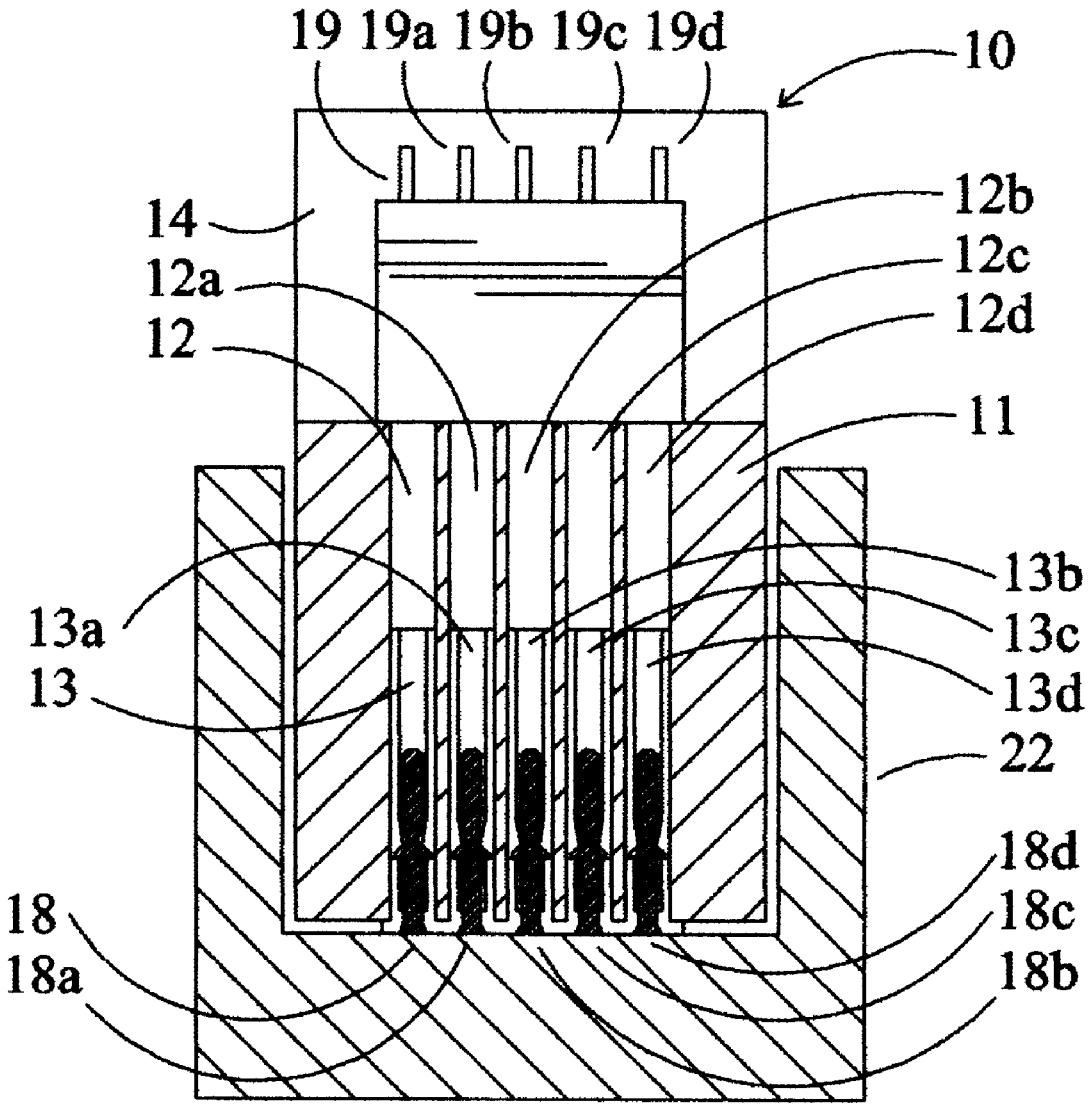
FIG. 6 is a cross-sectional view taken along line 6—6 of FIG. 5 showing the underside mounted to a mating connector receptacle.
Figure 7:
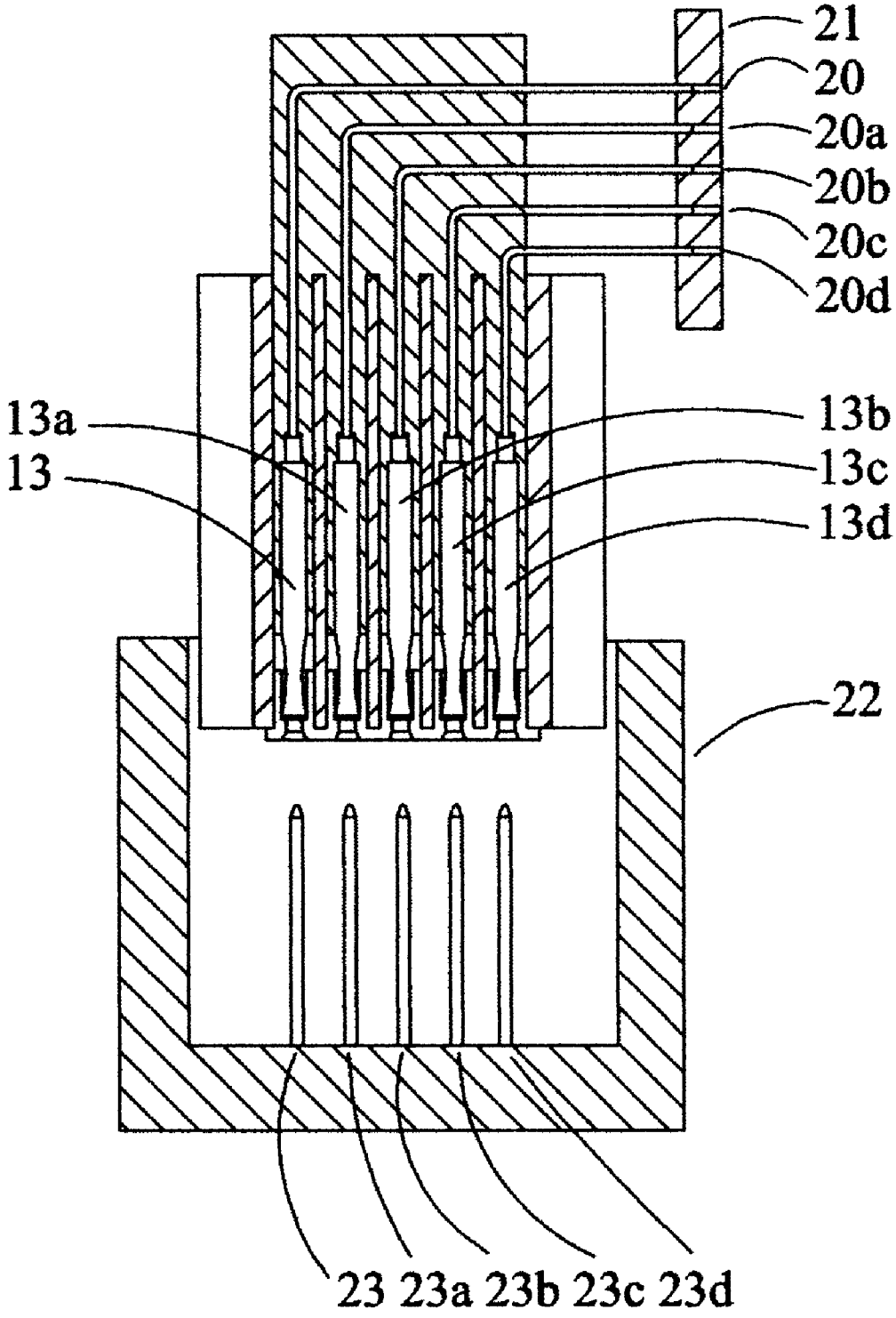
FIG. 7 is a cross sectional view showing the connector assembly mounted to a motherboard above the receptacle.
Figure 9:
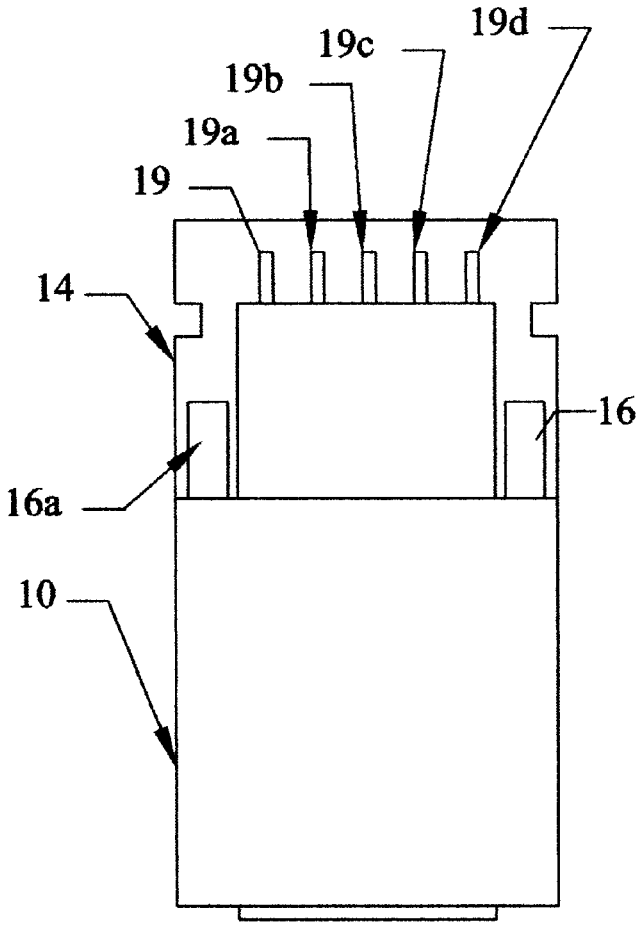
FIG. 9 is a top plan view of FIG. 8, showing the connector assembly for mounting to an electrical cable and the planer location of the ground tension contact points.
Figure 8:
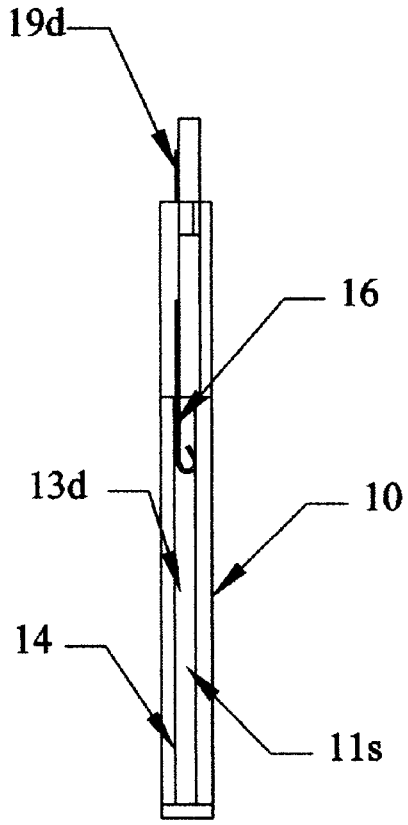
FIG. 8 is a side view of the connector assembly showing the ground contact tension points.
Figure 11:
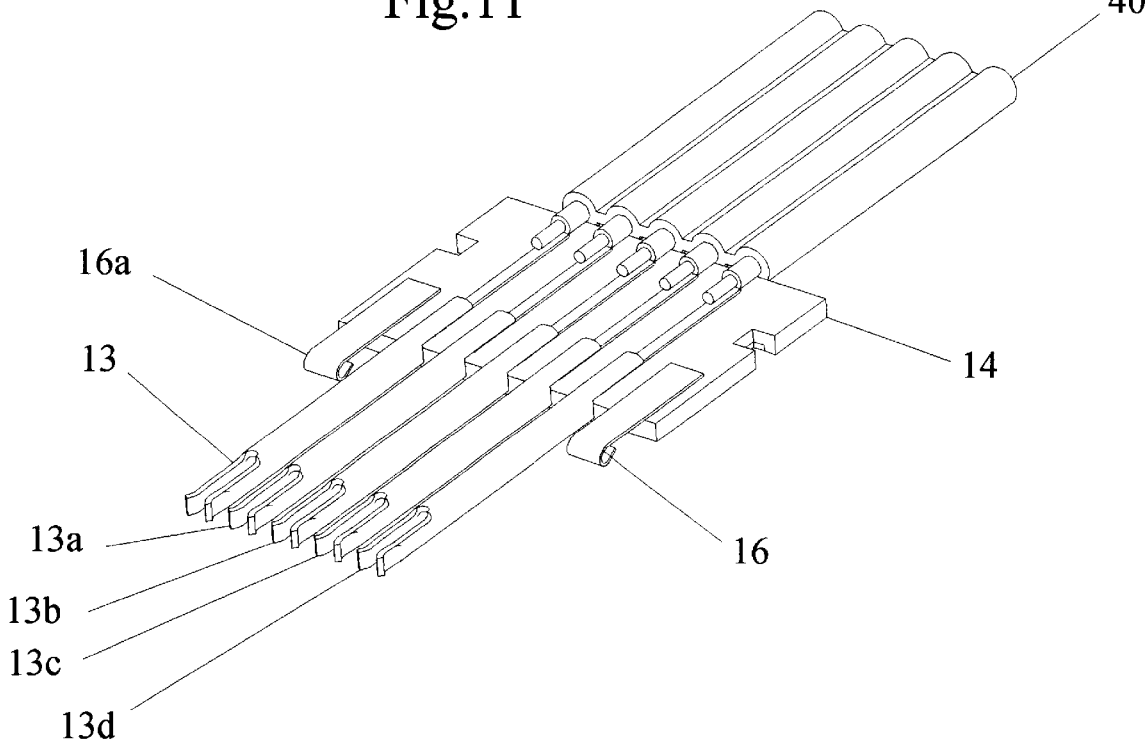
FIG. 11 is a perspective view showing the intermediate printed circuit board and contact point assembly terminated to an electrical cable.

Contact pins 13–13*d* are inserted into channels 12–12*d* (also referred to herein as "cavities"), guided by mating guides 18–18*d*. The latter are positioned at the mating end of housing 11 opposite the end where a intermediate printed circuit board (IPCB) 14 is connected. The mating guides are inserted into the housing by a press-fit, by a weld, or an adhesive (see FIGS. 1, 3 and 11). IPCB 14 includes solder tails 19, 19*a*, 19*b*, 19*c* and 19*d* or a board press-fit 20*a*, 20*b*, 20*c* and 20*d* that allow a cable or another printed circuit board to be attached to circuit board 14 (FIG. 7). The pin 13 is directly mounted to IPCB board 14 making up part of the connector assembly 10 for termination to an electrical cable assembly or the IPCB can be terminated to a printed circuit board (motherboard) 21 for the connector assembly to mate to a printed circuit board 22. The IPCB 14 can have circuit board traces that route signals through solder tails 19, 19*a*, 19*b*, 19*c* and 19*d* to the connector contacts in the housing module.

The other mating half (i.e., the receptacle) 22 of the connector accepts the extruded housing 11 in a single or stackable modular configuration 15 having the same center spacing. In an example embodiment, the center spacing is two mm or less. Each half of mating connector 22 has a contact pin 23 through 23*d*. The contact pins of each half make contact in a tuning-fork fashion (displacing each pin 13 along its length thus making electrical contact). The contact of the mating connector pins is made inside the extruded connector-housing module 11. Thus, the enclosed mating contact pins are inside the connector-housing cavity providing a four-sided metal enclosure along the length of the mating pins. Traditionally, connector housings are often injection molded from plastics and fit with a metal shield or metal stiffeners in an attempt to achieve a partially shielded enclosure.

The extruded housing 11, however, provides a four-sided metal enclosure for each contact along the length of the contact. Housing 11 (also referred to herein as "contiguous metal shield") is grounded through the intermediate printed circuit board 14 using contact tension points 16 and 16*a*. In this manner, shielded contact density is higher in the extruded module for each individual contacts then the previous patents.

For example, in the prior art housing modules, the signal density is limited by the spacing to the adjacent contact, which is surrounded by an injection-molded material in the multiple connector modules. The prior art makes some adjustment for the shield limitation by optionally grounding adjacent pins (e.g., alternate grounding pins 13 through 13*d* in the present invention) between the signal pins. In this manner, each signal pin may have an adjacent ground pin. In addition, certain prior art has one outside face on two sides of each module shielded by attaching a metal plate, versus the four sides of the present invention. The insulation between contacts in the prior art is typically injection-molded material. Thus, the signal or ground pins do not have a contiguous metal enclosure on all four sides.

In the prior art the shielded signal density tends to be limited by the need for adjacent ground pins or the mechanical construction of each connector module. This is also true when the mating halves of the connectors are joined. Thus, the signal density (i.e., the number of signal pins divided by the total number of signal and ground pins) in a five-row connector with the extreme outside pins and middle pin forming a ground shield for the signal contacts, there are only two signal remaining signal contact pins. Furthermore, there is limited contact shielding in the connector module. In the prior art, each individual contact does not have a rectangular metal enclosure. Rather, the entire connector module contains a plurality of contacts and metal plates covering three sides of the outside housing. The extruded connector housing module 11 provides channels 12 through 12*d* that enclose each of the example of individual metal contacts 13 through 13*d* in a contiguous metal shield 11 along the length of each contact.

Figure 10:
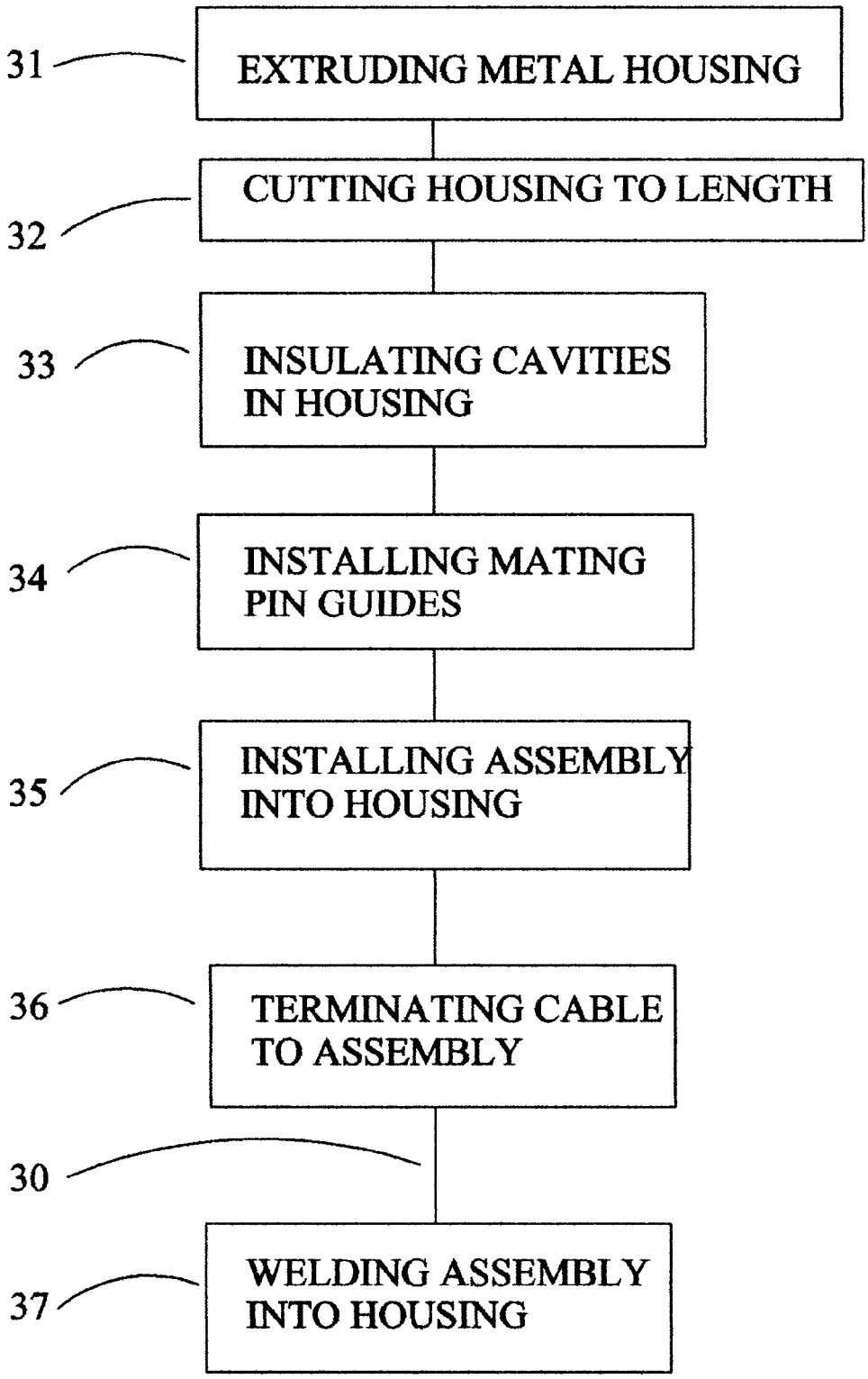
FIG. 10 is a block diagram of the novel method of producing an extruded metallic electrical connector assembly.

The method 30 of producing an extruded metallic electrical connector assembly (steps 31–37 of FIG. 10) according to the present invention comprises the steps of extruding a continuous metal housing having a plurality of channels 12 positioned therein (step 31); cutting said housing to the desired length (step 32); coating the inside of said channels of said metal housing with an insulation material (step 33); installing the mating guides (step 34); installing the printed circuit board into said housing (step 35); terminating electrical cable to the IPCB assembly used in cable assembly operation or IPCB fitted with wire mounting for motherboard installation (step 36); and electrically connecting (e.g., by welding) the assembly to the housing (step 37) to form a cable assembly thereby forming a cable assembly (step 40) or wire mounting to motherboard 21.

Electrical-Optical Hybrid Connector

The present invention also includes a novel hybrid concept of using the extruded metal housing and connecting same to an IPCB to facilitate both optical and electrical signal transmission. This is accomplished by making the connector have a hybrid configuration that permits the output of the connector at the intermediate printed circuit board to be a mix of optical and electrical transmission.

Figure 12:
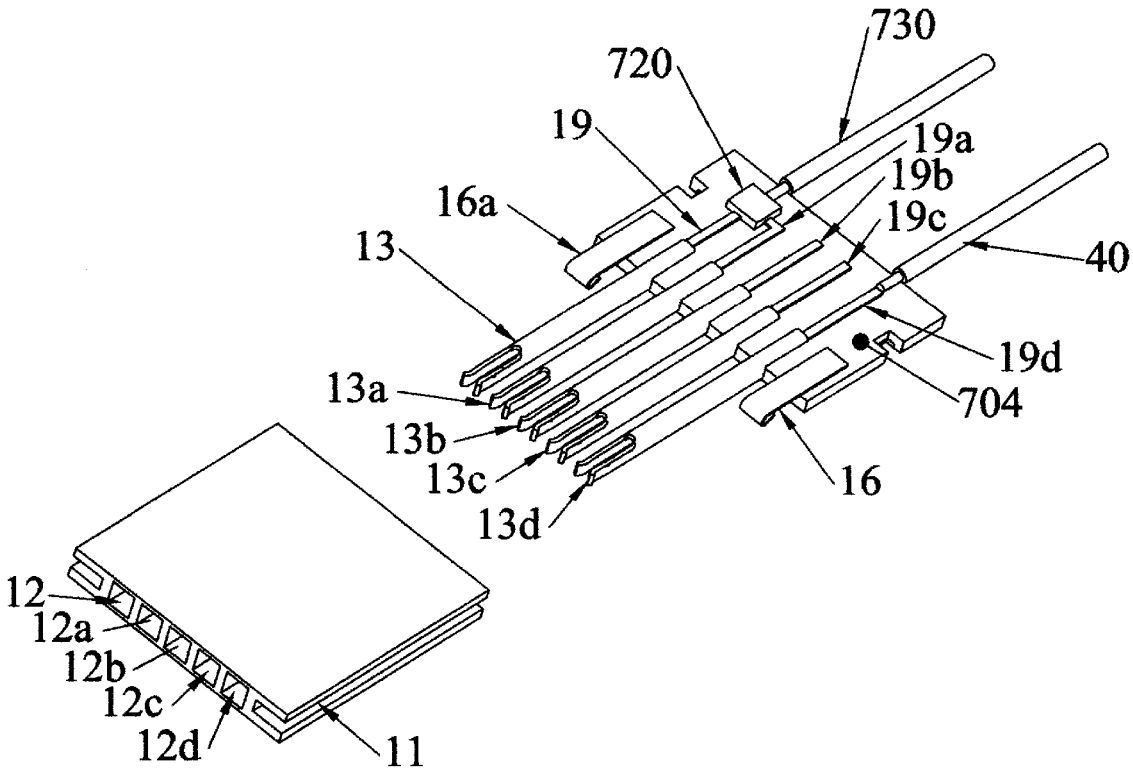
FIG. 12 is a perspective exploded view of the hybrid electrical-optical connector of the present invention similar to FIG. 11, but further including optical fibers and VCSELs attached to the intermediate printed circuit board.

Accordingly, with reference now to FIG. 12, there is shown an exploded view of the hybrid connector assembly 700 of the present invention. Hybrid connector 700 includes extruded metal connector housing 11, with channels 12–12*d* formed therein during extrusion, as described above. Connector 700 also includes IPCB 14 with a planar surface 704, which includes electrical contact pins 13–13*d*, and connector tension points 16 and 16*a* coupled to one end of the IPCB, also as described above. IPCB 14 also includes solder tails 19 (e.g., printed circuit board LAN), also described above, that connect contact pins 13–13*d* to one of either electrical cable (wire) 40 or one or more vertical cavity surface emitting lasers (VCSELs) 720 arranged on planar surface 704.

As is known in the art, a VCSEL is a device that takes a modulated electrical signal and converts it to a correspondingly modulated optical (laser) signal, or vice versa. Suitable VCSELs for the present invention are available, for example as part numbers ic-jwb 2.7 and ic-wk (laser-diode drivers) from IC Haus Corp., Sanford, Mich. (info@laserdriver.com), or from the Optical Interconnect Development Association, Washington, D.C., (Rockwell Science Center) model rsc 110 (laser driver 2.5–10 Gbps), or from W.L. Gore, Wilmington, Del. (VCSEL laser driver). Information about VCSELs can be found in a paper entitled "design of 2.5 Gbit/s GaAs laser driver with integrated APC for optical fiber communications," by Guillaume Fortin and Bozena Kaminska.

With continuing reference to FIG. 12, each VCSEL 720 receives a positive voltage and ground provided through dedicated contact pins (e.g. one of contact pins 13–13*d* and one of connection tension points 16) through conductive housing 11. One or more optical fibers (e.g., fiber cables) 730 are connected to IPCB 14 so as to be optically coupled to corresponding VCSELs 720, analogous to electrical wires 40 being electrically coupled to corresponding solder tails 19–19*d*. Optical fibers 730 may be single mode or multiple-mode, depending on the application.

In one mode of operation, an electrical signal enters assembly 700 through, say, pin 13*a* as shown. The electrical signal then travels through the associated solder tail 19*a* and into the corresponding VCSEL 720. The VCSEL converts the electrical signal into a corresponding optical signal, which is then passed to optical fiber 730. Assembly 700 can be used to go from optical to electrical signals (i.e., from driver to receiver) by reversing the VCSEL to operate as a laser receiver. Thus, hybrid connector assembly 700 allows for connection of both electrical and optical high-speed digital signals in a parallel configuration.

Figure 13:
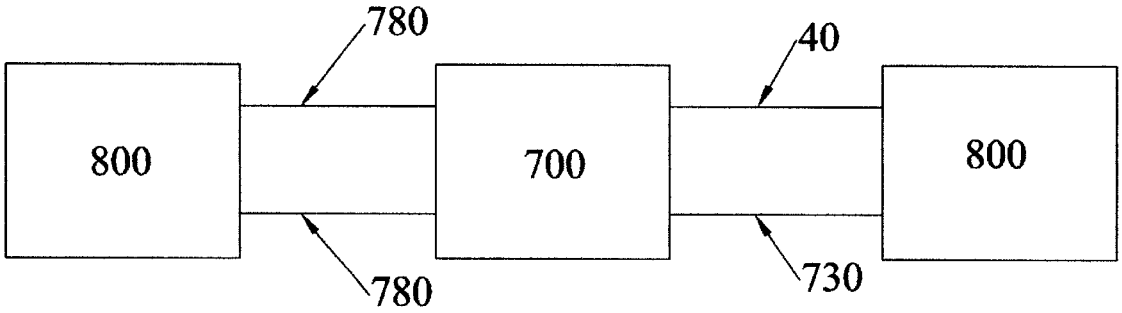
FIG. 13 is a schematic diagram of the hybrid connector of the present invention as shown in FIG. 12 as used to connect two remote circuits.

With reference to FIG. 13, an advantage of assembly 700 is connecting to different remote circuits 800 (e.g., back planes, mother boards, distribution panels, etc.) through assembly 700 with both optical fibers 730 and electrical wires 40 to one remote circuit, while electrically connecting to another remote circuit via one of a number of electrical connections 782 (e.g., vias on printed circuit boards, wires, etc.).

In a preferred embodiment of the present invention as illustrated in FIG. 13, the longer interconnections to remote circuits 800 can be accommodated by optical fiber 730 (thereby ensuring signal integrity), while the shorter interconnections can be (accommodated by more cost-effective electrical cable 40 while still ensuring signal integrity. Thus, both electrical and optical high-speed connections can be provided in the single connector of the present invention.

Electrical Impedance Matched Connector

With reference again to FIG. 12, channels 12, 12*a*, 12*b*, etc. of housing 11 can be sized (i.e., cross-sectional area) to achieve a desired impedance when mated with a contact (e.g., contacts 13, 13*a*, 13*b*, etc.) of a particular size. In an example embodiment of the present invention, contacts 13, 13*a*, 13*b*, etc. are capable of carrying an electrical signal having a discrete signal format, while in another embodiment the contacts can carry an electrical signal having a differential format used for logic in high-speed signal transmission. Further, the cross-sectional area of the contacts can be sized relative to the channel to achieve a desired connector impedance. This is because the connector impedance is determined by the relative cross-sectional area of the outer conductor (i.e., channel 12) to the cross-sectional area of the contact (e.g., 13), and the spacing between the conductive surfaces. For example, as discussed above, IEC specifications call for a two-millimeter (2 mm) on-center channels 12–12*d*.

In an example embodiment of the invention, the contact has a cross-sectional area such that it yields an impedance value of between about 45 and 60 ohms. However, the present invention is not limited by the IEC specifications. Accordingly, the connector impedance for a variety of different sized connectors can be matched set by selecting the ratio of the cross-sectional area of the channels to that of the contacts. This allows connector assembly 10 to provide the highest level of signal integrity by matching the impedance of the signal passing from pins 23, 23*a*, 23*b*, etc. to contacts 13, 13*a*, 13*b*, etc. (FIG. 7).

Further, the connector of the present invention is capable of passing a very high digital signal speed. The speed of a connector can be measured in gigabits per second, which is the frequency bandpass of a connector (measured in GHz) times 2. A typical high-speed electrical connector has a limited signal speed due to electrical and mechanical properties to approach and surpass 1 gigabit/second. The connector of the present invention is capable of passing signals at much higher speeds approaching 10 gigabits/second, a ten-fold increase over typical connectors.

The connector of the present invention should find utility over a wide range of high-speed communication applications. For example, the IEEE standard for the 1 gigabit/second Ethernet interconnect can be accomplished using either copper wires or optical fibers. However, the new IEEE 10 gigabit/second Ethernet standard calls for optical fibers only, recognizing the perceived limitation of copper wires. Thus the embodiment provides a choice between interconnects having more cost-effective copper versus fiber in a hybrid configuration.

Connector Cooling Channel And System

In electrical-optical (hybrid) assembly 700, electrical power may be dissipated by Joule heating caused by VSCEL 720 or by the power supply and connections (e.g., resistive heating of the connecting wires). Further, in both electrical connector assembly and hybrid assembly 700, Joule heating of the assembly may arise where one or more contacts 13, 13*a*, 13*b*, etc. are dedicated to carrying electrical power. Thus, it may be desirable to cool the assembly to reduce the risk of overheating elements of the assemblies, e.g., VCSEL 720, ICPB 14, or cable assembly 40.

In the present invention, extruded housing 11 has contiguous metal channels 12 formed by extrusion. As such, channels 12 are sealable with respect to fluid (e.g., gas or liquid). Thus, one or more of the connector channels 12, 12*a*, 12*b*, etc. can serve as cooling channels is they are kept open (i.e., free from one or more of electrical contact pins 13, 13*a*, 13*b*, etc.). In previous art, the mechanical constraints do permit sealing. Accordingly, in place of one or more of solder tails 19, 19*a*, 19*b*, etc. and the corresponding one or more of contacts 13, 13*a*, 13*b*, etc., one or more fluid channels 902 for carrying a fluid and is provided, as shown FIG. 14. Each fluid channel 902 has a first end 903 and a second end 904, wherein end 904 is sized to mate or otherwise connect with the corresponding one or more of channels 12, 12*a*, 12*b*, etc. An example material for fluid channel 902 is a plastic or polymer. Example fluids are inert gas, air, glycol, glycerin and water. The cooling fluid makes contact with housing 11 and removes the heat from the housing via heat conduction.

Figure 14:
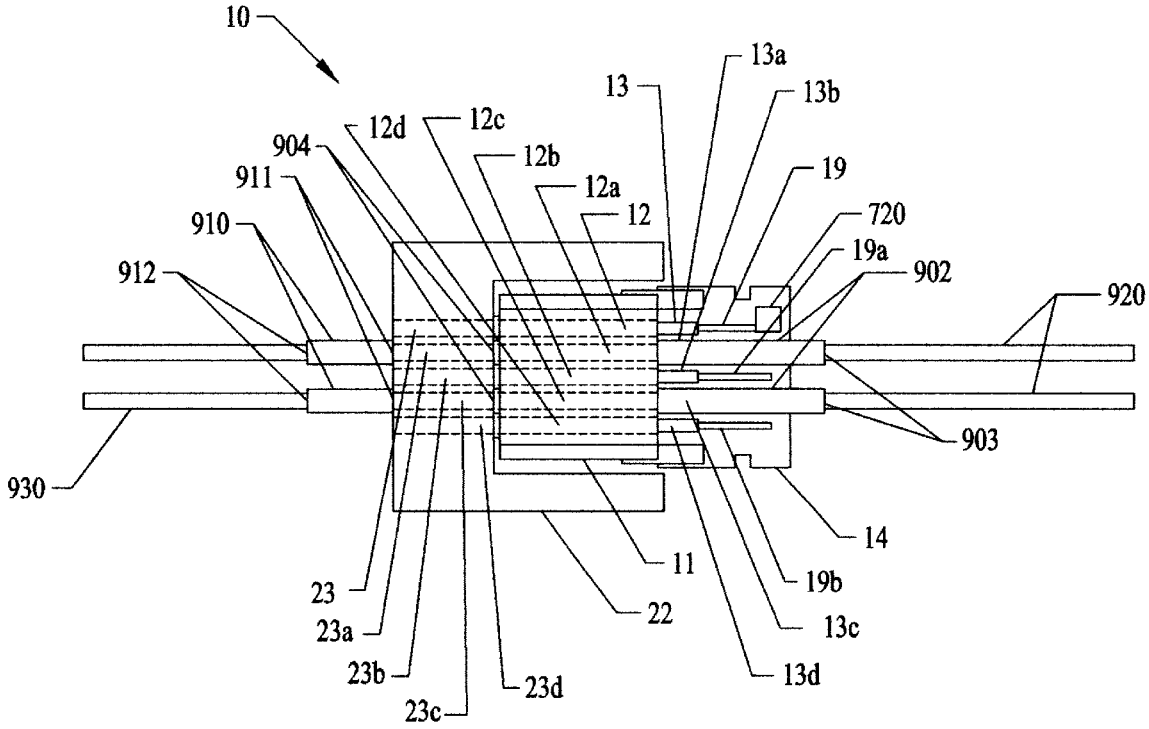
FIG. 14 is a plan view of the connector cooling system of the present invention.

Also included is one or more fluid channels 910 that replace one or more mating contact pins 23, 23*a*, 23*b*, etc. (see FIG. 7) that reside upon the other half (i.e., plug-halt) 22 of the connector receptacle. Each fluid channel 910 has a first end 911 and a second end 912. End 911 is sized to mate or otherwise connect with the corresponding one or more of channels 23, 23*a*, 23*b*, etc. of the mating receptacle 22 as shown in FIG. 14. As shown in FIG. 14, channels 23*a* and 23*c* ar designated as cooling channels. Fluid channels 910 are connected to mating receptacle 22 at the end where mating contact pins 13*a* and 13*c* are normally inserted. In an example embodiment, fluid channels 910 are the same as fluid channels 902.

Figure 15:
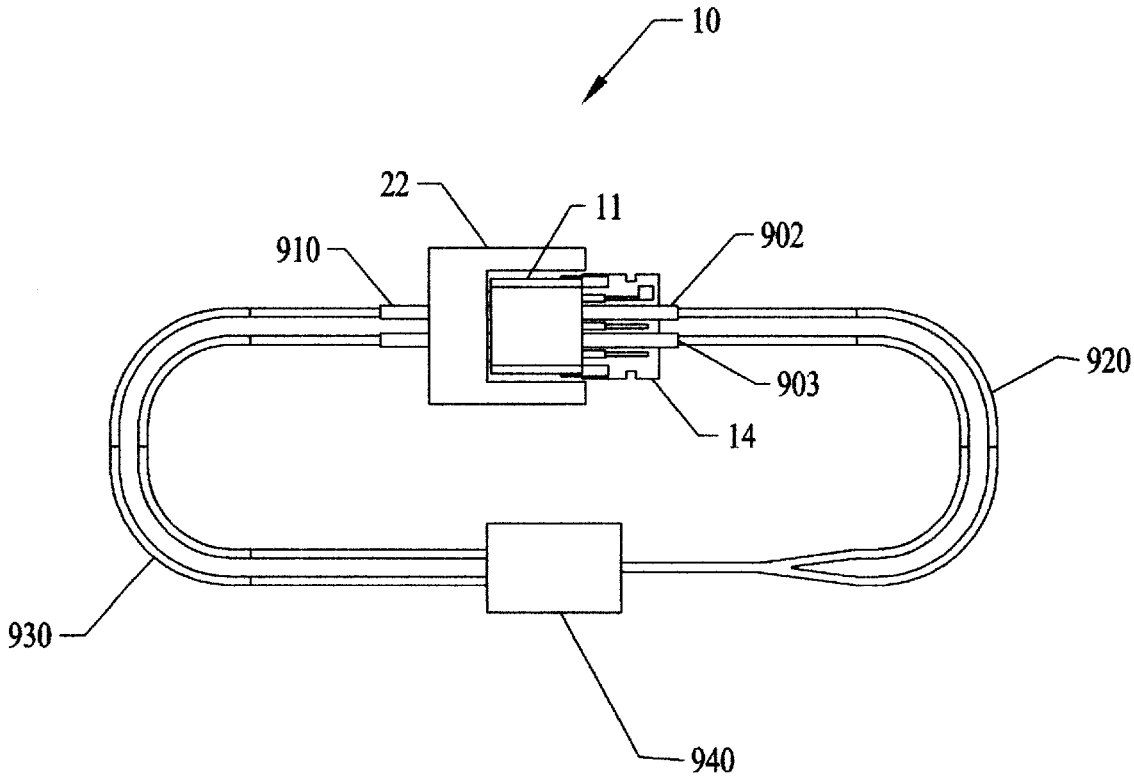
FIG. 15 is a plan view of the connector cooling system of the present invention shown connected to a fluid source via cooling lines.

Connected to each of the one or more fluid channels 902 at ends 903 is a fluid line 920, and connected to each of the one or more fluid channels 910 at end 912 is a fluid line 930 connected through end 904. Each of fluid lines 920 and 930 are connected to a fluid source 940 (FIG. 15) that flows the fluid through the fluid lines 920 and 930, fluid channels 902 and 910 and one or more of channels 12, 12*a*, 12*b*, etc. that are designated as cooling channels (FIG. 15). In FIGS. 14 and 15, channels 12*a* and 12*c* are designated as cooling channels to illustrate an example embodiment.

In an example embodiment, fluid lines 920 and/or 930 are single fluid lines that have branches connecting to each of the designated fluid channels, as illustrated in FIG. 15. In another example embodiment, fluid channels 902 and/or 910 have a circular in cross-section except for the ends that mate to the rectangular connector channels. Further in an example embodiment, the channels 12, 12*a*, 12*b*, etc. dedicated to cooling need not have an insulating layer formed therein, though it may be preferable to keep the insulating layer in the channel to prevent corrosion of housing 11.

The many features and advantages of the present invention are apparent from the detailed specification, and, thus, it is intended by the appended claims to cover all such features and advantages of the described apparatus that follow the true spirit and scope of the invention. Furthermore, since numerous modifications and changes will readily occur to those of skill in the art, it is not desired to limit the invention to the exact construction and operation described herein. Accordingly, other embodiments are within the scope of the appended claims.

What is claimed is:

1. A connector apparatus, comprising:

a metallic extruded housing having a plurality of connector channels formed wherein during extrusion, and having an insulating coating formed on the inside of the connector channels;

an intermediate printed circuit board (IPCB) with a plurality of electrical contact pins formed thereon and spaced apart to mate with the connector channels;

wherein each of the plurality of connector channels and the electrical contact pins are sized to provide a select connector electrical impedance;

one or more vertical cavity surface emitting lasers (VCSELs) mounted to the IPCB so as to be in electrical communication with one or more of the electrical contacts; and one or more optical fibers connected to the intermediate printed circuit board and arranged so that each optical fiber is in optical communication with a corresponding one of the one or more VCSELs.

2. The apparatus of claim 1, wherein the selected electrical impedance is between about 45 and 60 ohms.

3. The apparatus of claim 1, wherein the electrical contact pins are capable of carrying an electrical signal having a discrete signal format.

4. The apparatus of claim 1, wherein the electrical contact pins are capable of carrying an electrical signal having a differential signal format.

5. The apparatus of claim 1, wherein the connector can pass a signal having a speed greater than 1 gigabits/second.

6. The apparatus of claim 1, wherein the connector can pass a signal having a speed of up to 10 gigabits/second.

7. A connector apparatus, comprising:

a metallic extruded housing having a plurality of connector channels each having first and second ends and formed therein during extrusion, the connector channels having an insulating coating formed on the inside thereof; and an intermediate printed circuit board (LPCB) with a plurality of electrical contact pins spaced apart to mate with said plurality of connector channels;

one or more first fluid channels formed on the IPCB and connected to corresponding one or more of the plurality of connector channels at the first end;

one or more second fluid channels formed on a receptacle and mated to said one or more of the plurality of connector channels at the second end; a first fluid line connected to the one or more first fluid channels;

a second fluid line connected to the one or more second fluid channels; and wherein the first and second fluid lines are connected to a fluid source that flows a fluid through the first and second cooling lines, the first and second fluid channels, and the corresponding connector channels to cool the connector.

8. The apparatus of claim 7, wherein the fluid is one of: air, water, an inert gas, glycol, and glycerin.

9. A connector apparatus, comprising:

a metallic extruded housing having a plurality of connector channels each having first and second ends and formed therein during extrusion, with an insulating coating formed on the inside of select ones of the connector channels;

an intermediate; printed circuit board (IPCB) with a plurality of electrical contact pins spaced apart to mate with the select insulated connector channels;

one or more first fluid channels formed on the LPCB and connected to the non-insulated connector channels at the first end; and one or more second fluid channels formed on a receptacle of the connector and mated to said non-insulated connector channels at the second end.

10. The apparatus of claim 9, further including:

a first fluid line connected to the one or more first fluid channels;

a second fluid line connected to the one or more second fluid channels; and wherein the first and second fluid lines are connected to a fluid source that flows a fluid through the first and second cooling lines, the first and second fluid channels, and the corresponding non-insulated connector channels to cool the connector.

11. The apparatus of claim 10, wherein the fluid is one of: air, water, an inert gas, glycol, and glycerin.

12. A method of forming an electrical connection comprising:

forming a metallic extruded housing having a plurality of connector channels each having first and second ends and formed therein during extrusion;

forming an insulating coating on the inside of some or all of the connector channels; and inserting a plurality of electrical contact pins into a first end of the insulated connector channels, the plurality of electrical contact pins formed on an intermediate printed circuit board (IPCB) and spaced apart to mate with said plurality of connector channels;

inserting a plurality of mating pins into a second end of the insulated connector channels, the plurality of mating pins formed on a receptacle of the connector and spaced apart so as to mate with said plurality of insulated contact channels and establish contact with the electrical contact pins; and keeping one or more of the connector channels open and passing a cooling fluid through the one or more of the connector channels to cool the connector.

13. The method of claim 12, wherein the one or more open connector channels are not insulated.

14. The method of claim 12, further including forming first fluid channels in the IPCB and connecting the first fluid channels with the first end of the one or more connector channels used to cool the connector.

15. The method of claim 14, further including forming second fluid channels on the plug-half of the connector and connecting the second fluid channels with the second end of the one or more connector channels used to cool the connector.

16. The method of claim 15, further including connecting the first and second fluid channels to respective first and second fluid lines; and connecting the first and second fluid lines to a fluid source adapted to flow fluid through the first and second cooling lines.

* * * * *